US006295894B1

(12) United States Patent
Craig

(10) Patent No.: US 6,295,894 B1
(45) Date of Patent: Oct. 2, 2001

(54) BEVERAGE PACKAGE WITH INCORPORATED BOTTLE CAP OPENER

(76) Inventor: Richard Craig, 8645 Leisure La., Escondido, CA (US) 92026

( * ) Notice: Subject to any disclaimer, the term of this patent is extended or adjusted under 35 U.S.C. 154(b) by 0 days.

(21) Appl. No.: 09/489,992

(22) Filed: Jan. 21, 2000

(51) Int. Cl.[7] ..... B67B 7/44

(52) U.S. Cl. ..... 81/3.09; 81/3.08; 81/3.15; 206/427; 206/818

(58) Field of Search ..... 81/3.09, 3.08, 81/3.15, 3.31; 220/4.01, 735; 206/139, 427, 216, 818

(56) References Cited

U.S. PATENT DOCUMENTS 2,806,393 * 9/1957 Vickers .
2,990,972 * 7/1961 Benedetti .
3,055,541 * 9/1962 Bonkowski .
3,120,140 * 2/1964 Wiles .
4,335,814 * 6/1982 Benning et al. .
4,852,432 * 8/1989 Rodriquez Salcedo .

* cited by examiner

*Primary Examiner*—Timothy V. Eley
*Assistant Examiner*—Willie Berry, Jr.
(74) *Attorney, Agent, or Firm*—Goldstein Law Offices, P.C.

(57) ABSTRACT

A beverage package with incorporated bottle cap opener including a container adapted for holding a plurality of bottles with twist-off caps therein. A removable bottle opener is removably coupled with respect to the container. The bottle opener includes a magnetic layer.

5 Claims, 3 Drawing Sheets

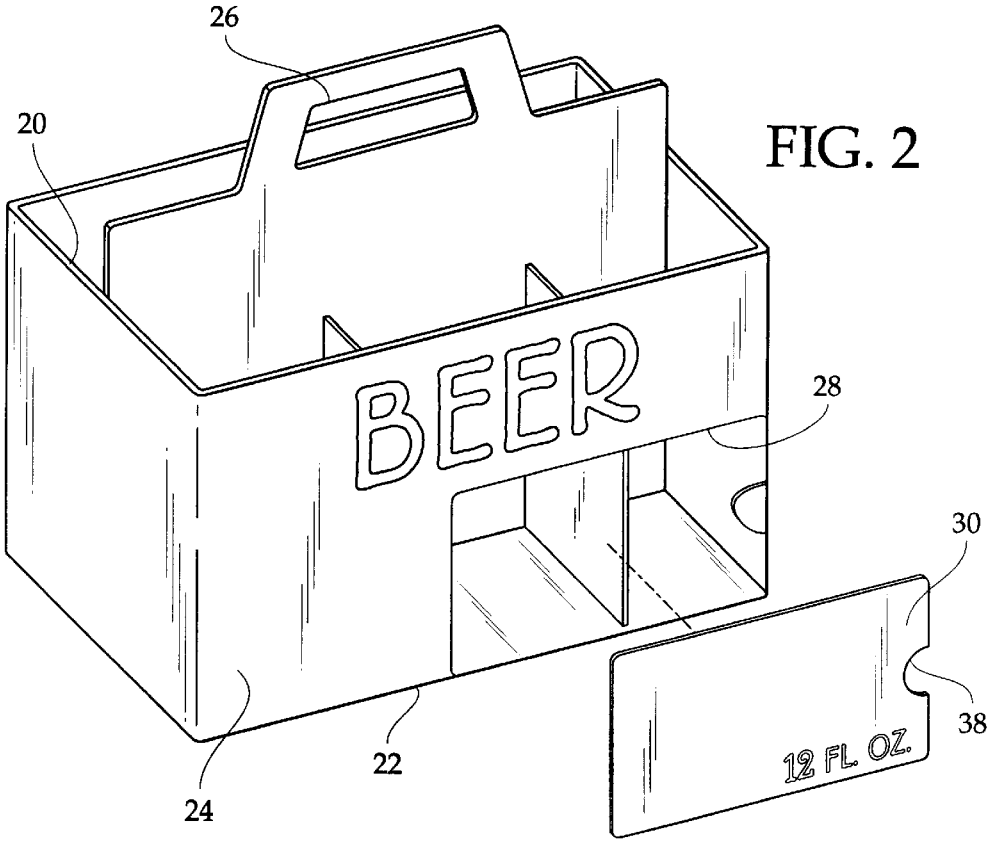
FIG. 2
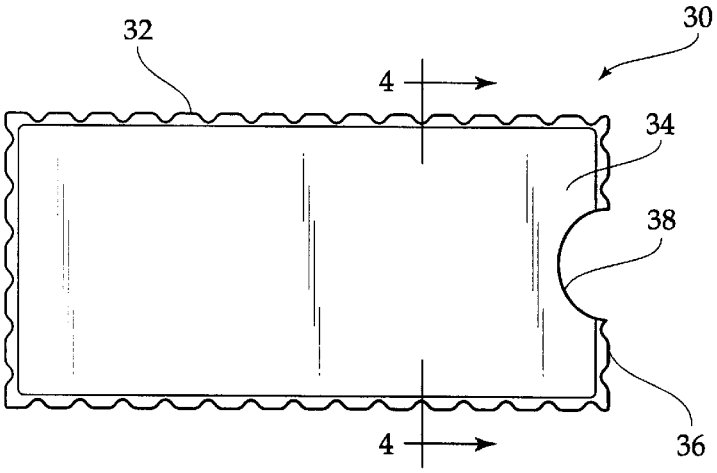
FIG. 3
FIG. 4
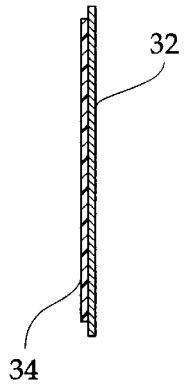

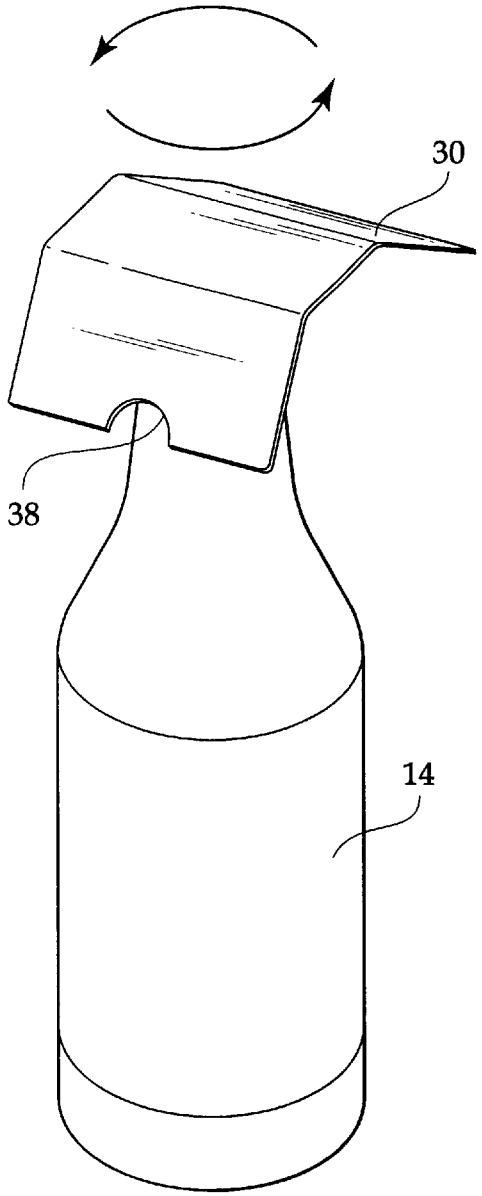
FIG. 5
FIG. 6
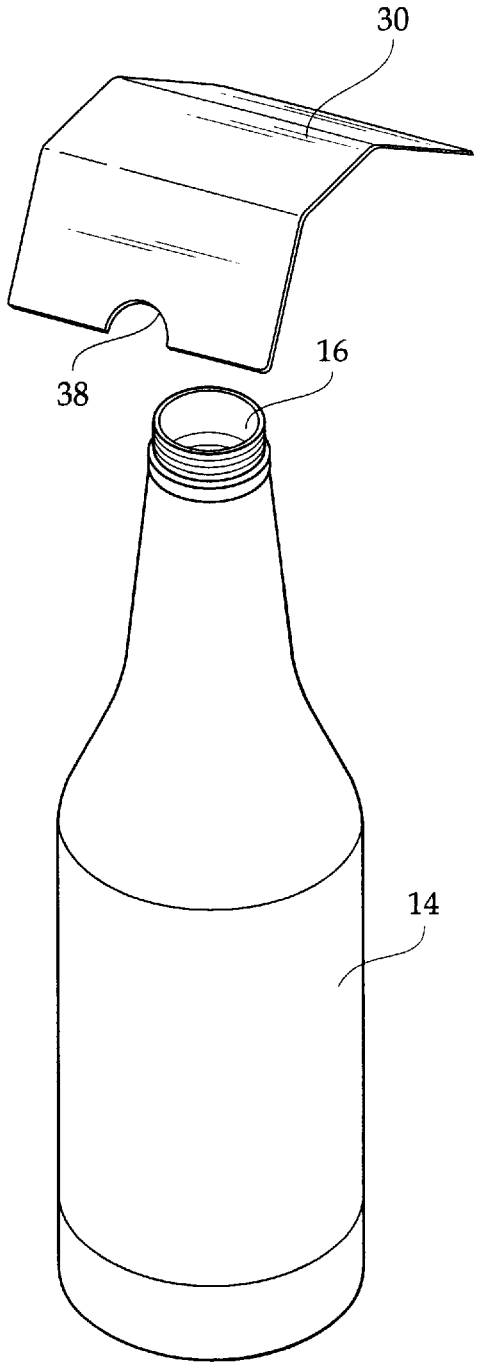

BEVERAGE PACKAGE WITH INCORPORATED BOTTLE CAP OPENER

BACKGROUND OF THE INVENTION

The present invention relates to a beverage package with incorporated bottle cap opener and more particularly pertains to housing a plurality of bottles while enabling caps thereof to be easily removed.

The use of bottle opening devices is known in the prior art. More specifically, bottle opening devices heretofore devised and utilized for the purpose of removing caps from bottles are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,633,740 to Jacobs discloses a plate member with an aperture suited for gripping and removing a twist off bottle cap. U.S. Pat. No. 5,054,338 to Weis discloses a combination tool for removing twist off bottle caps and opening carton tops. U.S. Pat. No. 5,082,145 to McDonald discloses a plate like wine cast accessory with a bottle opener incorporated.

While these devices fulfill their respective, particular objective and requirements, the aforementioned patents do not describe a beverage package with incorporated bottle cap opener for housing a plurality of bottles while enabling caps thereof to be easily removed.

In this respect, the beverage package with incorporated bottle cap opener according to the present invention substantially departs from the conventional concepts and designs of the prior art, and in doing so provides an apparatus primarily developed for the purpose of housing a plurality of bottles while enabling caps thereof to be easily removed.

Therefore, it can be appreciated that there exists a continuing need for a new and improved beverage package with incorporated bottle cap opener which can be used for housing a plurality of bottles while enabling caps thereof to be easily removed. In this regard, the present invention substantially fulfills this need.

SUMMARY OF THE INVENTION

In the view of the foregoing disadvantages inherent in the known types of bottle opening devices now present in the prior art, the present invention provides an improved beverage package with incorporated bottle cap opener. As such, the general purpose of the present invention, which will be described subsequently in greater detail, is to provide a new and improved beverage package with incorporated bottle cap opener which has all the advantages of the prior art and none of the disadvantages.

To attain this, the present invention essentially comprises a container adapted for holding a plurality of bottles therein. The bottles each have an open upper end with a twist-off cap coupled thereto. The container is defined by an open upper end, a closed lower end, surrounding side walls, and a handle portion. One of the surrounding side walls has an opening therethrough. A removable bottle opener is removably coupled with the opening in the side wall of the container. The bottle opener is comprised of an outer material layer and an inner magnetic layer. The bottle opener has an outer edge having an indentation formed therein.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved beverage package with incorporated bottle cap opener which has all the advantages of the prior art bottle opening devices and none of the disadvantages.

It is another object of the present invention to provide a new and improved beverage package with incorporated bottle cap opener which may be easily and efficiently manufactured and marketed.

It is a further object of the present invention to provide a new and improved beverage package with incorporated bottle cap opener which is of durable and reliable construction.

An even further object of the present invention is to provide a new and improved beverage package with incorporated bottle cap opener which is susceptible of a low cost of manufacture with regard to both materials and labor, and which accordingly is then susceptible of low prices of sale to the consuming public, thereby making such a beverage package with incorporated bottle cap opener economically available to the buying public.

Even still another object of the present invention is to provide a new and improved beverage package with incorporated bottle cap opener for housing a plurality of bottles while enabling caps thereof to be easily removed.

Lastly, it is an object of the present invention to provide a new and improved beverage package with incorporated bottle cap opener including a container adapted for holding a plurality of bottles with twist-off caps therein. A removable bottle opener is removably coupled with respect to the container. The bottle opener includes a magnetic layer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a perspective view of the present invention illustrating the removable bottle opener thereof.

FIG. 3 is a rear view of the removable bottle opener of the present invention.

FIG. 4 is a cross-sectional view of the present invention as taken along line 4–4 of FIG. 3.

FIG. 5 is a perspective view of the removable bottle opener illustrated in use.

FIG. 6 is a perspective view of the removable bottle opener illustrated after removing a cap from a bottle.

The same reference numerals refer to the same parts through the various figures.

DESCRIPTION OF THE PREFERRED EMBODIMENT

Figure 1:
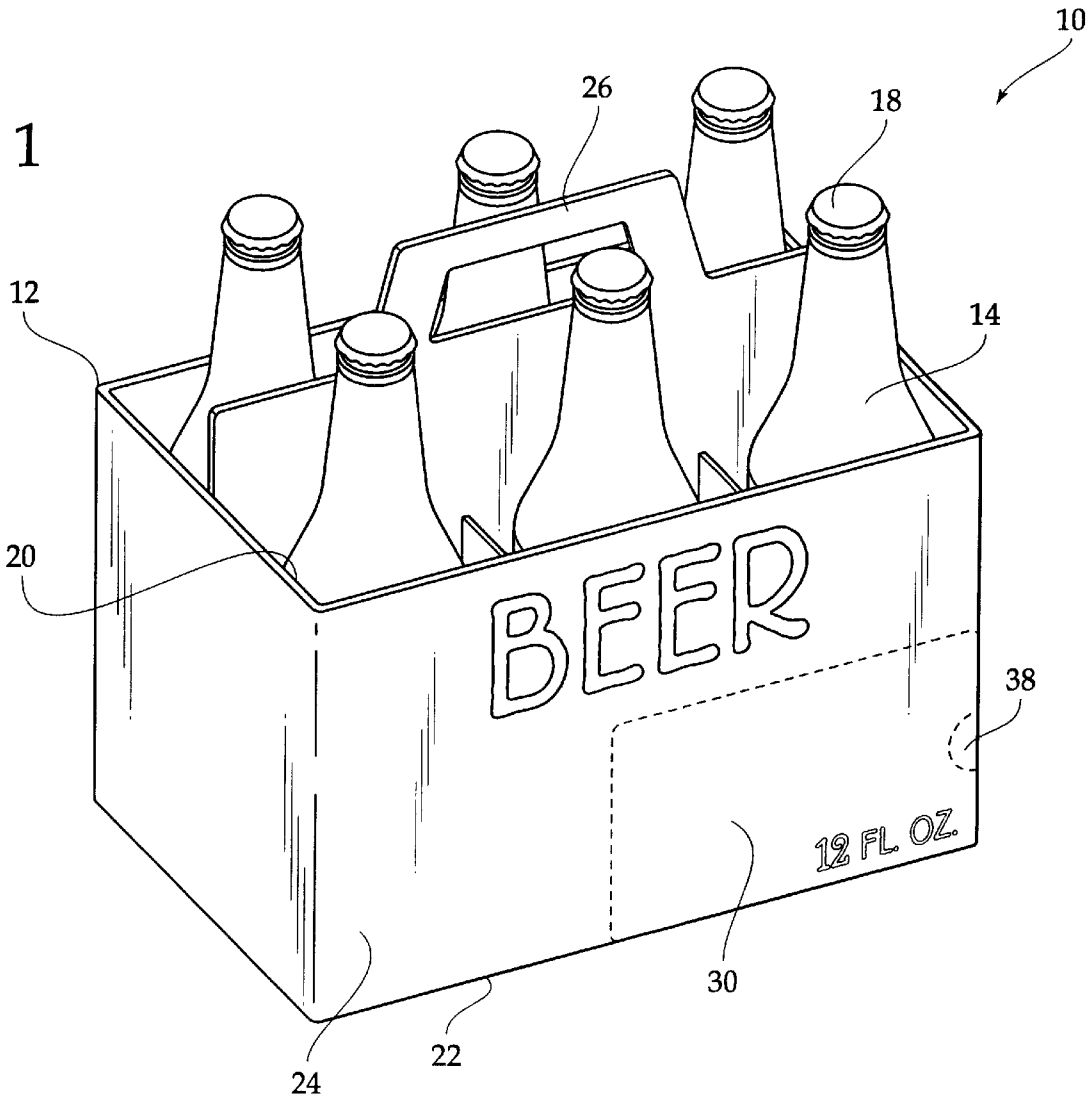
FIG. 1 is a perspective view of the preferred embodiment of the beverage package with incorporated bottle cap opener constructed in accordance with the principles of the present invention.

With reference now to the drawings, and in particular, to FIGS. 1 through 6 thereof, the preferred embodiment of the new and improved beverage package with incorporated bottle cap opener embodying the principles and concepts of the present invention and generally designated by the reference number 10 will be described.

Specifically, it will be noted in the various Figures that the device relates to a beverage package with incorporated bottle cap opener for housing a plurality of bottles while enabling caps thereof to be easily removed. In its broadest context, the device consists of a container and a removable bottle opener. Such components are individually configured and correlated with respect to each other so as to attain the desired objective.

The container 12 is adapted for holding a plurality of bottles 14 therein. The bottles 14 each have an open upper end 16 with a twist-off cap 18 coupled thereto. The container 12 is defined by an open upper end 20, a closed lower end 22, surrounding side walls 24, and a handle portion 26. One of the surrounding side walls has an opening 28 therethrough.

The removable bottle opener 30 is removably coupled with the opening 28 in the side wall of the container 12. The bottle opener 30 is comprised of an outer material layer 32 and an inner magnetic layer 34. The outer material layer 32 is constructed from the same material that makes up the container 12. Note FIGS. 3 and 4. The bottle opener 30 has an outer edge 36 having an indentation 38 formed therein. The indentation 38 allows the bottle opener 30 to be removed from the container 12. Note FIG. 2. Once removed, the bottle opener 30 is placed over the twist-off cap 18 with the magnetic layer 34 in contact with the cap 18. The user then presses the bottle opener 30 around the cap 18 and twists so as to remove the cap 18 from the bottle 14. Note FIGS. 5 and 6.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A beverage package with incorporated bottle cap opener for housing a plurality of bottles while enabling caps thereof to be easily removed comprising, in combination:

a container adapted for holding a plurality of bottles therein, the bottles each having an open upper end with a twist-off cap coupled thereto, the container being defined by an open upper end, a closed lower end, surrounding side walls, and a handle portion, one of the surrounding side walls having an opening therethrough;

a removable bottle opener removably coupled with the opening in the side wall of the container, the bottle opener being comprised of an outer material layer and an inner magnetic layer, the bottle opener having an outer edge having an indentation formed therein.

2. The beverage package with incorporated bottle cap opener as set forth in claim 1 wherein the outer material layer is constructed of a same material of the container.

3. A beverage package with incorporated bottle cap opener for housing a plurality of bottles while enabling caps thereof to be easily removed comprising, in combination:

a container adapted for holding a plurality of bottles with twist-off caps therein, said container defined by an open upper end, a closed lower end, surrounding side walls, and a handle portion, one of the surrounding side walls having an opening therethrough for receiving the removable bottle opener therein;

a removable bottle opener removably coupled with respect to the container, the bottle opener including a magnetic layer.

4. The beverage package with incorporated bottle cap opener as set forth in claim 3 wherein the bottle opener is comprised of an outer material layer and an inner magnetic layer.

5. The beverage package with incorporated bottle cap opener as set forth in claim 3 wherein the bottle opener has an outer edge having an indentation formed therein.

* * * * *